United States Patent [19]

Tanaka et al.

[11] 4,102,361

[45] Jul. 25, 1978

[54] FLUID SUPPLYING AND DISCHARGING APPARATUS FOR SHUTTLELESS WEAVING LOOM

[75] Inventors: Shigenori Tanaka, Hachioji; Akio Tojo, Higashi, both of Japan

[73] Assignee: Nissan Motor Company, Ltd., Japan

[21] Appl. No.: 745,112

[22] Filed: Nov. 26, 1976

[30] Foreign Application Priority Data

Jul. 23, 1976 [JP] Japan ..... 51-87221

[51] Int. Cl.[2] ..... D03D 47/30

[52] U.S. Cl. ..... 139/435

[58] Field of Search ..... 139/144, 435; 226/7, 226/97

[56] References Cited

U.S. PATENT DOCUMENTS

| | | | |
|---|---|---|---|
| 2,796,085 | 6/1957 | Svaty et al. | 139/435 |
| 2,936,002 | 5/1960 | Opletal et al. | 139/435 |
| 3,782,422 | 1/1974 | Vermeulen | 139/435 |
| 3,805,850 | 4/1974 | Duynhoven et al. | 139/435 |
| 3,977,442 | 8/1976 | Shibata et al. | 139/435 |

*Primary Examiner*—Henry S. Jaudon

*Attorney, Agent, or Firm*—Robert E. Burns; Emmanuel J. Lobato; Bruce L. Adams

[57] ABSTRACT

In a weaving loom of the shuttleless type having a fluid discharge nozzle adapted to shoot a jet stream of fluid entraining a pick of weft yarn for inserting the weft yarn into the weaving shed of the loom, a fluid supplying and discharging apparatus comprising first valve means alternately opened in synchronism with the weaving cycles of the loom, second valve means for providing communication between the first valve means and a source of fluid under pressure when the loom is in operation, third valve means to be manually operated to open to provide communication between the fluid source and the nozzle through a passageway by-passing the second valve means which is closed when the loom is at rest, and flow restricting means for reducing the fluid pressure to be supplied to the nozzle through the third valve means.

38 Claims, 6 Drawing Figures

FLUID SUPPLYING AND DISCHARGING APPARATUS FOR SHUTTLELESS WEAVING LOOM

BACKGROUND OF THE INVENTION

The present invention relates in general to weaving looms and, specifically, to a weaving loom of the shuttleless type in which a pick of weft yarn is shot into the shed of warp yarns by a jet stream of fluid under pressure such as, typically, compressed air. More specifically, the present invention is concerned with a fluid supplying and discharging apparatus for use in a weaving loom of the particular type.

A conventional fluid supplying and discharging apparatus of a shuttleless weaving loom has ordinarily incorporated therein an intermittent-motion flow control valve which is located upstream of a fluid discharge nozzle and which is operated to alternately open and close in synchronism with the weaving operation of the loom. When the loom in operation is brought to a stop, the control valve is automatically closed and cuts off the flow of fluid to the fluid discharge nozzle from the source of the fluid so that the fluid discharge nozzle ceases ejection of the fluid provided the loom is stopped with a proper timing, viz., at an instant intervening between termination of a weft shooting cycle and an instant at which the subsequent weft shooting cycle is to start. If, however, it happens that the loom is stopped during a weft shooting cycle in which fluid is being ejected from the fluid discharge nozzle, the flow of the fluid which has been passed through the control valve by the point of time at which the control valve is closed is beyond the control of the valve and is allowed out of the discharge nozzle into the shed of warp yarns. This not only results in a waste of the pressurized fluid and is therefore objectionable from an economical point of view but invites a problem in that the weft yarn which is kept entrained on the jet stream of the fluid issuing from the fluid discharge nozzle and which is thus kept taut for an extended period of time after the loom is stopped is subject to a danger of breakage. These problems could be avoided if a flow shut-off valve adapted to automatically close in response to stoppage of the loom is provided anterior to the fluid discharge nozzle so that the flow of the fluid which has been passed through the intermittent-motion flow control valve located upstream of the fluid discharge nozzle is cut off upstream of the nozzle immediately when the loom is brought to a stop. When the loom is to be started from the rest condition, the flow shut-off valve is opened and the first pick of weft yarn is inserted into the weaving shed of the loom by the aid of a jet stream of the fluid which is continuously discharged from the fluid discharge nozzle by manually operating the control valve. Because, in this instance, the flow shut-off valve located upstream of the nozzle is kept open, the pick of the weft yarn entrained on the jet stream of the fluid issuing from the nozzle is subjected to a forceful tension until insertion of the first pick of weft yarn by manual operation is complete. The weft yarn is thus not only subject to the danger of being broken as in the case of the previously described prior-art apparatus but is forced to untwist and loose its tensile strength if the weft yarn is a spun yarn.

The prior-art fluid supplying and discharging apparatus of the previously described character has a modified version in which a fluid storage chamber is provided between the intermittent-motion flow control valve and the source of the fluid under pressure. The fluid storage chamber has a capacity adapted to store therein a predetermined volume of fluid to be consumed in each weft shooting operation and is operative to periodically deliver the predetermined volume of fluid to the fluid discharging nozzle via the intermittent-motion flow control valve during each of the weft inserting cycles. The provision of the fluid storage chamber is thus useful for limiting the volume of the fluid to be discharged from the fluid discharge nozzle after the loom is brought to a stop during a weft inserting cycle. When weaving operation is to be reopened with the loom equipped with a fluid supplying and discharging apparatus using such a fluid storage chamber, the loom is first driven to operate in normal condition until the fluid storage chamber is completely filled with the fluid supplied from the fluid source. The loom is thereafter operated on a reverse course until the loom restores the initial condition ready to have the first pick of weft yarn shot into the weaving shed. The control valve downstream of the fluid storage chamber is then opened by manual operation for shooting the first pick of weft yarn into the weaving shed by the aid of the fluid which has been stored in the fluid storage chamber. Let alone the numerous steps which must thus be taken for shooting the first pick of weft yarn from the fluid discharge nozzle, a problem is encountered in that the volume of the fluid stored in and delivered from the fluid storage chamber is insufficient for enabling the pick of weft to be shot into the weaving shed with certainty by manual operation.

SUMMARY OF THE INVENTION

The present invention contemplates elimination of all these problems that have been inherent in prior-art fluid supplying and discharging apparatus for use in a weaving loom of the shuttleless type.

It is, therefore, an object of the present invention to provide an improved fluid supplying and discharging apparatus for use in a shuttleless weaving loom with which only a limited volume of fluid is discharged from the fluid discharge nozzle when the loom is brought to a stop during a weft shooting cycle.

It is another object of the present invention to provide an improved fluid supplying and discharging apparatus for use in a shuttleless weaving loom with which the first pick of weft yarn can be easily and with certainty inserted into the weaving shed of the loom by manual operation when the loom is to be started from rest condition.

It is still another object of the present invention to provide an improved fluid supplying and discharging apparatus for use in a shuttleless weaving loom with which the danger of the weft yarn being broken or untwisted when the loom is brought to a stop or to be started from the rest condition.

In accordance with the present invention, these objects are accomplished in a fluid supplying and discharging apparatus which comprises a source of fluid under pressure, fluid discharge means communicable with the fluid source and operative to eject a jet stream of the fluid into a weaving shed formed by warp yarns in the loom, first valve means provided between the fluid source and the fluid discharge means and operative to intermittently open in synchronism with the weaving cycles of the loom, second valve means provided between the first valve means and the fluid source and operative to establish communication between the fluid source and the first valve means in response to operative condition of the loom, the second valve means interrupting the communication between the fluid source and the first valve means in response to inoperative condition of the loom, third valve means bypassing the second valve means from the fluid source, the third valve means being manually operable for providing communication between the fluid source and the fluid discharge means when manually operated to open, and flow restriction means for reducing to a predetermined level the pressure of the fluid to be passed to the fluid discharge means from the third valve means. The flow restriction means may be provided either between the fluid source and the third valve means or between the third valve means and the fluid discharge means. When provided between the third valve means and the fluid discharge means, the flow restriction means has a fluid inlet port located downstream of the third valve means and a fluid outlet port which may be located to intervene either between the first and second valve means or between the first valve means and the fluid discharge means. If it is desired that the flow restriction means be provided between the fluid source and the third valve means, then the third valve means may have a fluid outlet port intervening between the first and second valve means or between the first valve means and the fluid discharge means.

By preference, the fluid supplying and discharging apparatus according to the present invention may further comprise fluid storage means provided between the first and second valve means and operative to store therein a predetermined volume of fluid to be consumed for each weft shooting operation at the fluid discharge means and delivering the predetermined volume of fluid to the fluid discharge means through the first valve means when the first valve means and at least one of the first valve means and the third valve means are concurrently open. If, in this instance, the flow restriction means is provided downstream of the third valve means as above-mentioned, then the fluid outlet port of the flow restriction means may be in communication with the flow storage means or located to intervene between the fluid storage means and the first valve means or between the first valve means and the fluid discharge means. If, however, the flow restriction means is provided upstream of the third valve means, then the fluid outlet port of the third valve means may be in communication with the fluid storage means or may be located to intervene between the fluid storage means and the first valve means or between the first valve means and the fluid discharge means.

The flow restriction means thus incorporated into the fluid supplying and discharging apparatus according to the present invention may comprise a main body formed with first and second bore portions, first and second tubular members each having a longitudinal bore which is open at both ends of the tubular member, the first and second tubular members being disengageably mounted on the main body so that communication is provided between the first bore portion in the main body and the longitudinal bore in the first tubular member and between the second bore portion in the main body and the longitudinal bore in the second tubular member, and an orifice formed between the first and second bore portions in the main body. The orifice thus formed in the main body may have a fixed cross sectional area or a cross sectional area which is manually adjustable during use of the apparatus.

Furthermore, the flow restriction means and the third valve means of the apparatus according to the present invention may be constructed separately of each other or, as an alternative, in a single unit which functions in part as the flow restriction means and in part as the manually operable third valve means.

BRIEF DESCRIPTION OF THE DRAWINGS

The features and advantages of the fluid supplying and discharging apparatus according to the present invention will be more clearly understood from the following description taken in conjunction with the accompanying drawings in which like reference numerals designate the same or corresponding units or elements throughout the figures and in which.

DESCRIPTION OF THE PREFERRED EMBODIMENTS

Figure 1:
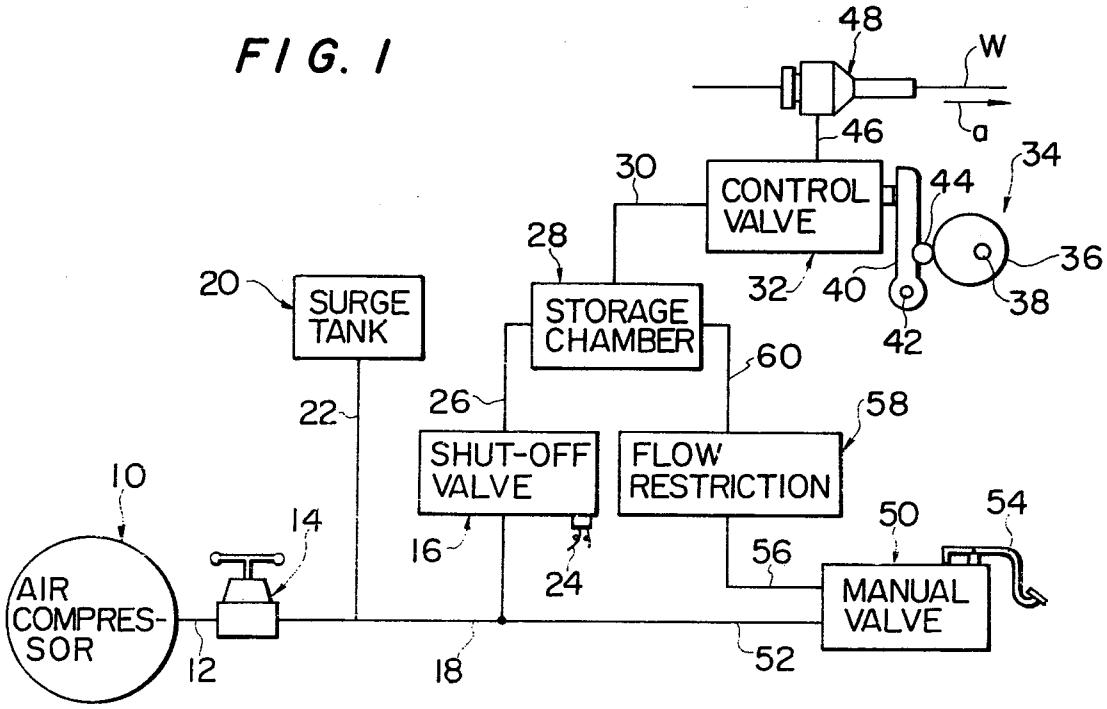
FIG. 1 is a block diagram schematically illustrating the general arrangement of a fluid supplying and discharging apparatus embodying the present invention.

Referring to FIG. 1 of the drawings, the fluid supplying and discharging apparatus embodying the present invention comprises a source 10 of fluid under pressure such as compressed air. For the sake of convenience, the fluid source 10 is herein assumed to be an air compressor and, accordingly, the fluid under pressure delivered from the fluid source is assumed to be compressed air. The air compressor 10 has a discharge port communicating through a passageway 12 with a pressure regulator 14 which in turn is in communication with a flow shut-off valve unit 16 by way of a passageway 18. By preference, a surge tank 20 may be installed in communication with the passageway 18 through a passageway 22 for the purpose of absorbing fluctuations or pulsations in the pressure of compressed air to be delivered from the pressure regulator 14. The flow shut-off valve unit 16 is adapted to open in response to operative condition of the loom and to close when the loom is brought to a stop. The valve unit 16 may be of a solenoid-operated type having lead wires 24 electrically connected across suitable switch means (not shown) responsive to stoppage of operation of the loom. The flow shut-off valve 16 has a fluid outlet port communicating through a passageway 26 with a fluid storage chamber 28 having a capacity adapted to store therein a predetermined volume of air to be consumed for each weft shooting operation. The fluid storage chamber 28 in turn is in communication by way of a passageway 30 with an intermittent-motion flow control valve unit 32. The flow control valve unit 32 is adapted to alternately open and close in synchronism with the weaving cycles of the loom and is driven by suitable intermittent-motion actuating means such as a cam-operated valve actuating unit 34 which is shown comprising an eccentric cam 36 rotatable on a shaft 38, a rocking lever 40 pivoted as at 42 and engaging the valve unit 32, and a cam follower 44 mounted on the rocking lever 40 and in rolling contact with the cam 36. The cam 36 is adapted to be driven to rotate about the axis of the shaft 38 in synchronism with the weaving cycles of the loom. When the cam 36 is thus rotated, the cam follower 44 is alternately raised and lowered over the axis of the shaft 38 so that the rocking lever 40 engaging the valve unit 32 is driven to oscillate between angular positions to open and close the valve unit 32. The construction and arrangement of the valve actuating unit 34 is merely by way of example and, for this reason, may be arbitrarily modified or changed insofar as the intrinsic function thereof can be maintained.

The intermittent-motion flow control valve unit 32 has a fluid outlet port communicating through a passageway 46 with a fluid discharge nozzle 48 through which a weft yarn indicated by W is passed when the weaving loom is in operation. Though not shown in the drawings but as is well known in the art, the fluid discharge nozzle 48 is positioned in conjunction with a weft length measuring unit adapted to feed the weft yarn W in predetermined length during each cycle of weaving operation and a weft detaining unit adapted to temporarily retain the weft yarn passed through the length measuring unit. Upon termination of a weaving cycle, that portion of the weft yarn W which has been retained in the detaining unit is passed to the fluid discharge nozzle 48 and is shot into a weaving shed (not shown) of the loom by a jet stream of fluid which is ejected from the nozzle 48. The fluid discharge nozzle 48 is thus located in proximity to one lateral end of the weaving shed and is directed in line with the weaving shed.

The fluid supplying and discharging apparatus embodying the present invention further comprises a manually-operated auxiliary valve unit 50 which has a fluid inlet port communicating through a passageway 52 with the previously mentioned passageway 18 interconnecting the pressure regulator 14 and the flow shut-off valve unit 16. If desired, the auxiliary valve unit 50 may be in direct communication with the air compressor 10. The auxiliary valve unit 50 is biased to close and is driven to open by means of suitable solenoid-operated valve actuating means (not shown) provided with a manually-operated switch or by means of a suitable foot-operated lever or pedal which is shown at 54 in FIG. 1. Thus, the term "manually-operated" as herein referred to does not necessarily import that the auxiliary valve unit 50 is to be operated by a human effort applied by hand directly thereto or to any actuating or servo means provided for the valve unit but should be interpreted as implying that the auxiliary valve unit 50 (which is referred to as third valve means in the apending claims) may be operated by any mechanical force or forces applied directly or indirectly to the valve unit by personal intervention.

The manually-operated auxiliary valve unit 50 has a fluid outlet port communicating through a passageway 56 with a flow restriction unit 58. The flow restriction unit 58 in turn has a fluid outlet port which is in communication with the previously described fluid storage chamber 28 through a passageway 60. The flow restriction unit 58 is formed with an orifice (not shown in FIG. 1) having a fixed or adjustable cross sectional area so that the pressure of the fluid passed through the flow restriction unit 58 is reduced to a predetermined level which is dictated by the calibrated cross sectional area of the orifice. If desired, the flow restriction unit 58 may be arranged so that the fluid outlet port thereof is in communication with the passageway 30 intervening between the fluid storage chamber 28 and the flow control valve unit 32 or with the passageway 46 intervening between the flow control valve unit 32 and the fluid discharge nozzle 48. As an alternative, the flow restriction unit 58 may be provided downstream of the manually-operated auxiliary valve unit 50 preferably in the passageway 52 intervening between the fluid inlet port of the auxiliary valve unit 50 and the passageway 18 leading to the flow shut-off valve unit 16.

When the weaving loom is in operation, the air compressor 10 is driven by suitable drive means (not shown) and delivers compressed air to the pressure regulator 14 through the passageway 12. The air under the pressure thus regulated to a predetermined optimum level is directed through the passageway 16 to the flow shut-off valve unit 16 and further through the passageway 52 toward the manually-operated auxiliary valve unit 50. Under normal operating condition of the loom, the auxiliary valve unit 50 is held closed and the flow shut-off valve unit 16 is held open. The compressed air in the passageway 18 is thus passed through the flow shut-off valve unit 16 to the passageway 26 and through the passageway 26 to the fluid storage chamber 28 and fills up the chamber 28. The flow control valve unit 32 is operated to alternately open and close in cycles synchronized with the weaving cycles of the loom by means of the cam-operated valve actuating unit 34. When the flow control valve unit 32 is thus open, the compressed air which has been stored in the fluid storage chamber 28 is passed through the valve unit 32 and past the valve unit 32 to the fluid discharge nozzle 48, from which the compressed air is ejected as a jet stream into the weaving shed of the loom. The pick of the weft yarn W which has been fed to the fluid discharge nozzle 48 is thus entrained on the jet stream of air issuing from the nozzle 48 and is shot into the jet weaving shed as indicated by arrow *a*. When the predetermined volume of compressed air which has been stored in the fluid storage chamber 28 is consumed, the flow control valve unit 32 is closed by the valve actuating unit 34 and interrupts the communication between the passageways 30 and 46. The fluid storage chamber 28 then restarts to store therein the compressed air passed through the flow shut-off valve unit 16 until the chamber 28 is replenished with compressed air. The weft yarn W is in this fashion cyclically inserted into the weaving shed with the flow control valve 32 driven to alternately open and close by the intermittent-motion valve actuating unit 34. When the fluid storage chamber 28 is alternately filled and evacuated with compressed air, pulsations are created in the pressure of the gas in the fluid circuit including the flow shut-off valve unit 16 and the passageways 18 and 26. Such pulsations in the fluid pressure are absorbed by the surge tank 20 communicating with the passageway 18.

When the loom is brought to a stop, then the flow shut-off valve unit 16 is automatically closed and interrupts the communication between the fluid storage chamber 28 and the air compressor 10 and at the same time the intermittent-motion valve actuating unit 34 stops to operate. If, in this instance, the loom and accordingly the valve actuating unit 34 are stopped to operate during a weft shooting cycle in which the flow control valve unit 32 is still in open condition, the compressed air remaining in the fluid storage chamber 28 is allowed through the valve unit 32 into the fluid discharge nozzle 48 and is thus ejected from the nozzle 48. The weft yarn which has been fed to the fluid discharge nozzle 48 from the weft retaining unit (not shown) is shot into the weaving shed of the loom and is ready for re-opening of the weaving operation after downtime.

The volume of the compressed air to be ejected from the fluid discharge nozzle 48 is limited by the capacity of the fluid storage chamber 28 so that the weft yarn shot into the weaving shed at the end of the weaving operation is precluded from being subjected to an excess force of the jet stream issuing from the nozzle 48. Because, however, of the fact that the force effective to shoot the weft yarn W into the weaving shed by the compressed air allowed out of the fluid discharge nozzle 48 during the last weft shooting cycle is limited and is accordingly insufficient for enabling the weft yarn W to be perfectly inserted into the weaving shed, it is often required to have the imperfectly inserted weft yarn entrained for a second time on a jet stream of the fluid shot into the weaving shed when the weaving operation is to be re-opened after the downtime period. For this purpose, the pedal 54 is depressed to open the auxiliary valve unit 50 before the loom is started. The auxiliary valve unit 50 being thus open, the compressed air in the passageway 52 is passed through the valve unit 50 and is directed through the flow restriction unit 58 into the fluid storage chamber 28. The intermittent-motion valve actuating unit 34 having been stopped to operate during the last weft shooting cycle of the preceding weaving operation, the flow control valve unit 32 is kept open before the loom is to be re-started so that the compressed air entering the fluid storage chamber 28 is passed through the flow control valve unit 32 to the fluid discharge nozzle 48 and is ejected from the nozzle 48 into the weaving shed until the pedal 54 is released and the auxiliary valve unit 50 is closed. The pressure of the compressed air to be admitted into the fluid storage chamber 28 is reduced to a predetermined level by means of the flow restriction unit 58 so that the weft yarn in the weaving shed can be entrained on the jet stream of the fluid from the fluid discharge nozzle 48 continuously for a desired period of time until the insertion of the weft yarn into the weaving shed is complete.

Figure 2:
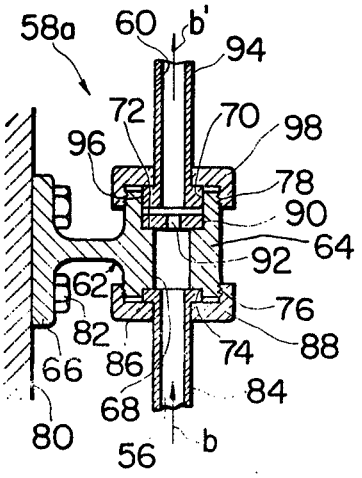
FIG. 2 is a longitudinal sectional view of a first preferred example of flow restriction means forming part of the fluid supplying and discharging apparatus illustrated in FIG. 1.
Figure 3:
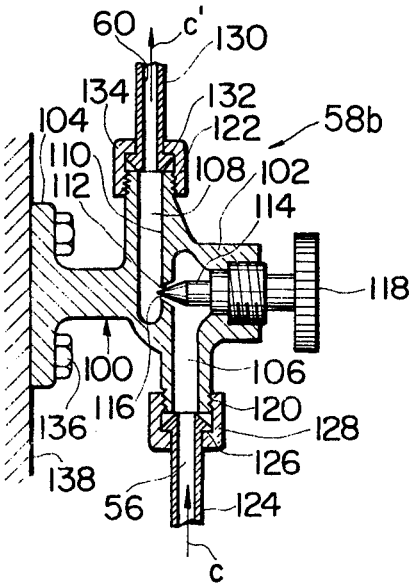
FIG. 3 is a view similar to FIG. 2 but shows a second preferred example of the flow restriction means of the apparatus illustrated in FIG. 1.
Figure 4:
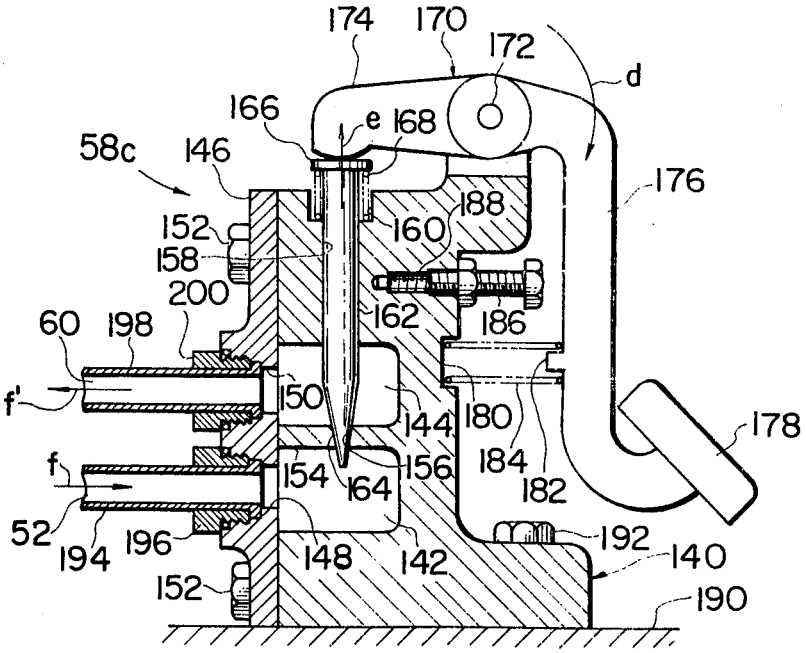
FIG. 4 is a sectional view showing, partly in side elevation, an integral flow restriction and manual valve unit which may be incorporated in the apparatus of FIG. 1.

Preferred examples of the detailed construction of the flow restriction unit 58 thus functioning are illustrated in FIGS. 2 to 4.

In FIG. 2, the flow restriction unit designated in its entirety by 58*a* is shown comprising a main body 62 consisting of a cylindrical portion 64 and a bracket portion 66. The cylindrical portion 64 is formed with a bore consisting of a first axial bore portion 68 which is open at one axial end of the cylindrical portion 62 and a second axial bore portion 70 which is open at the other axial end of the cylindrical portion 64 and which is continuous to the first axial bore portion 68, the first and second axial bore portions 68 and 70 having respective center axes which are substantially in line with each other. The second axial bore portion 70 is larger in diameter than the first axial bore portion 68 so that an annular face 72 is formed at the inner axial end of the second axial bore portion 70, the inner circumferential end of the annular face 72 defining the inner axial end of the first axial bore portion 68. The cylindrical portion 64 is further formed with an annular groove 74 at its inner peripheral edge defining the outer axial end of the first axial bore portion 68 and with external threads at its axial ends as indicated at 76 and 78. The main body 62 is fixedly mounted on a suitable stationary support member or structure 80 by suitable fastening means such as bolts 82 securing the bracket portion 66 to the support member or structure 80. The support member or structure 80 may be part of the loom construction. A first fluid conducting pipe 84 having an annular flange portion 86 at one end thereof is fitted to the cylindrical portion 64 of the main body 62 with the flange portion 86 closely received in the annular groove 74 in the cylindrical portion 64. The pipe 84 has a longitudinal bore extending throughout the length of the pipe and opening at the end of the flange portion 86 of the pipe into the first axial bore portion 68 in the main body 62. The longitudinal bore in the first fluid conducting pipe 84 constitutes the passageway 56 leading from the previously described manually-operated auxiliary valve unit 50 (FIG. 1). The pipe 84 is clamped to the cylindrical portion 64 of the main body 62 by means of a nut 88 engaging the external thread 76 of the cylindrical portion 64 and fixedly holding the flange portion 86 of the pipe 84 in the annular groove 74. An annular member 90 is positioned within the second axial bore portion 70 in the main body 62 and is seated on the previously mentioned annular face 72 at the inner axial end of the second axial bore portion 70. Thus, the annular member 90 has its opening 92 located to have its inner axial end contiguous to the inner axial end of the first axial bore portion 68 and provides communication between the first and second axial bore portions 68 and 70. The opening 92 in the annular member 90 is smaller in diameter than the first axial bore portion 68 and constitutes an orifice in the flow restriction unit 50*a* shown in FIG. 2. A second fluid conducting pipe 94 having an annular flange portion 96 at one end thereof is fitted to the cylindrical portion 64 of the main body 62 with the flange portion 96 closely received in the second axial bore portion 70 and on the outer end face of the annular member 90 held in the bore portion 70. The second fluid conducting pipe 94 has a longitudinal bore extending throughout the length of the pipe 94 and opening at the end of the flange portion 96 and in close proximity to the other axial end of the opening or orifice 92 in the annular member 90. The longitudinal bore in the second fluid conducting pipe 94 constitutes the passageway 60 providing communication between the flow restriction unit 58 and the previously described fluid storage chamber 28 (FIG. 1). Similarly to the first fluid conducting pipe 84, the second fluid conducting pipe 94 is clamped to the cylindrical portion 64 of the main body 62 by means of a nut 98 engaging the external thread 78 of the cylindrical portion 64 of the main body 62

The diameter of the opening or orifice 92 in the annular member 90, viz., the inside diameter of the annular member 90 is selected in such a manner as to achieve a desired differential pressure across the annular member 90 so that the fluid passed from the fluid inlet passageway 56 in the first fluid conducting pipe 84 to the fluid outlet passageway 60 in the second fluid conducting pipe 94 as indicated by arrows *b* and *b'* in FIG. 2 is reduced to a predetermined level. The fluid pressure to be developed downstream of the annular member 90 can be varied arbitrarily by exchanging the annular member 90 with an annular member having a differently sized opening. The annular member 90 can be easily replaced with another annular member by disassembling the nut 98 and the second fluid conducting pipe 94 from the cylindrical portion 64 of the main body 62, placing the new annular member on the annular face 72 in the cylindrical portion 64 of the main body 62, and therafter fitting the pipe 94 to the cylindrical portion 64 by the nut 98 so that the new annular member is clamped between the annular face 72 and the end face of the flange portion 96 of the fluid conducting pipe 94.

If desired, the second fluid conducting pipe 94 providing the fluid outlet passageway 56 may be connected not to the fluid storage chamber 28 but to the passageway 30 between the fluid storage chamber 28 and the flow control valve unit 32 or to the passageway 46 between the flow control valve unit 32 and the fluid discharge nozzle 48 or the first and second fluid conducting pipes 84 and 94 providing the fluid inlet and outlet passageways may be connected to the passageway 18 leading from the fluid source 10 and the fluid inlet port of the manually-operated auxiliary valve unit 50, respectively, in the arrangement of FIG. 1, as previously alluded to. As an alternative, the longitudinal bores in the first and second fluid conducting pipes 84 and 94 may be utilized as fluid outlet and inlet passageways, respectively, for the flow restriction unit 58*a* of FIG. 2.

While the flow restriction unit 58*a* of FIG. 2 is thus provided with the orifice 92 having a fixed cross sectional area although such a cross sectional area can be varied by exchanging the annular member 90 with another as above described, each of the flow restriction units illustrated in FIGS. 3 and 4 is arranged to have an orifice having variable cross sectional area.

Referring to FIG. 3, the flow restriction unit now designated by 58*a* comprises a main body 100 consisting of a bored portion 102 and a bracket portion 104. The bored portion 102 is formed with elongated first and second bore portions 106 and 108 which are open at the opposite ends of the bored portion 102. The first and second bore portions 106 and 108 are in part substantially parallel with each other on both sides of an intermediate wall portion 110 forming part of the main body 100. The intermediate wall portion 110 is formed with a conical opening 112 providing communication between the first and second bore portions 106 and 108 and tapering from the first bore portion 106 toward the second bore portion 108, the opening 112 having a center axis which is substantially perpendicular to the directions in which the bore portions 106 and 108 extend. A needle valve element 114 having a tapered end portion laterally projects through the first bore portion 106 and is axially movable through the opening 112 in the intermediate wall portion 110 so that an annular orifice 116 is formed in the opening 112 as shown. The needle valve element 114 is connected to or integral with a knurled adjustment wheel 118 by a screw-threaded valve stem (not shown) or by a screw-threaded stem portion forming part of the valve element 114. The tapered end portion of the needle valve element 114 is thus axially moved through the opening 112 and as a consequence the cross sectional area of the annular orifice 116 formed around the tapered end portion of the valve element 114 is continuously varied when the adjustment wheel 118 is manually rotated. The bored portion 102 of the main body 100 is further formed with external threads 120 and 122 which are in surrounding relationship to outer axial end portions of the first and second bore portions 106 and 108, respectively.

A first fluid conducting pipe 124 having a generally annular flange portion 126 at one end thereof is fitted to the bored portion 102 of the main body 100 by means of a nut 128 engaging the external thread 120 of the bored portion 102 so that the first bore portion 106 is in communication with the longitudinal bore in the pipe 124, the bore constituting the passageway 56 leading from the previously described manually-operated auxiliary valve unit 50 (FIG. 1). Likewise, a second fluid conducting pipe 130 having a generally annular flange portion 132 at one end thereof is fitted to the bored portion 102 of the main body 100 by means of a nut 134 engaging the external thread 122 of the bored portion 102 so that the second bore portion 108 is in communication with the longitudinal bore in the pipe 130. The longitudinal bore in the second fluid conducting pipe 130 constitutes the passageway 60 providing communication between the flow restriction unit 58 and the fluid storage chamber 28 in the arrangement of FIG. 1. The bracket portion 104 of the main body 100 is secured by suitable fastening means such as bolts 136 to a suitable stationary support member or structure 138 which may form part of the loom construction.

The flow restriction unit 58*b* being thus constructed and arranged, restricted fluid communication is provided between the fluid inlet and outlet passageways 56 and 60 in the first and second fluid conducting pipes 124 and 130, respectively, as indicated by arrows *c* and *c'* through the annular orifice 116 formed between the first and second bore portions 106 and 108. The flow rate of the fluid from the first portion 106 into the second bore portion 108 and accordingly the degree of reduction in the pressure of the fluid passed from the fluid inlet passageway 56 to the fluid outlet passageway 60 are thus determined by the cross sectional area of the annular orifice 116 and can therefore be continuously varied by turning the adjustment wheel 118 in either direction to move the tapered end portion of the needle valve element 114 forwardly or backwardly through the tapered opening 112 in the intermediate wall portion 110.

If desired, the second fluid conducting pipe 130 providing the fluid outlet passageway 60 may be connected to the passageway 30 between the fluid storage chamber 28 and the flow control valve unit 32 or to the passageway 46 between the flow control valve unit 32 and the fluid discharge nozzle 48 or the first and second fluid conducting pipes 124 and 130 providing the fluid inlet and outlet passageways may be connected to the passageway 18 leading from the fluid source 10 and the fluid inlet port of the manually-operated auxiliary valve unit 50, respectively, in the arrangement of FIG. 1. As an alternative, the longitudinal bores in the first and second fluid conducting pipes 124 and 130 may be utilized as fluid outlet and inlet passageways, respectively for the flow restriction unit 58*b* of FIG. 2.

While each of the flow restriction units hereinbefore described with reference to FIGS. 2 and 3 is constructed separately of the associated auxiliary valve unit 50, the flow restriction unit may be constructed integrally with the valve unit 50, a preferred example of such a device being shown in FIG. 4.

Referring to FIG. 4, the integral flow-restriction and manual valve designated in its entirety by 58*c* comprises a main body 140 which is formed with first and second cavities 142 and 144 which are arranged substantially in parallel with each other and which are open at one end face of the main body 140. An end plate 146 formed with openings 148 and 150 is fixedly attached to the above-mentioned end face of the main body 140 by suitable fastening means such as bolts 152 so that the first and second cavities 142 and 144 in the main body 140 are open through the openings 148 and 150, respectively, in the end plate 146 and thus constitute first and second bore portions in the main body 140. The main body 140 has between the first and second bore portions 142 and 144 an intermediate wall portion 154 which is formed with an opening 156 providing communication between the first and second bore portions 142 and 144 and tapering from the second bore portion 144 toward the first bore portion 142. The opening 156 has a center axis which is substantially perpendicular to the directions in which the cavities or bore portions 142 and 144 extend. The main body 140 is further formed with an elongated bore 158 which is in line with the tapered opening 156 in the intermediate wall portion 154 and which is open at one end to the second bore portion 144 and at the other end to a recess 160 which is slightly larger in diameter than the bore 158, as shown. A needle valve element 162 is axially slidable through the elongated bore 158 and has a tapered inner end portion 164 movable through the tapered opening 156 so as to close the opening 156 by the tapered inner end portion 164 when the needle valve element 156 is in a foremost axial position and to form an annular orifice in the opening 156 around the tapered inner end portion 164 of the valve element 162 when the needle valve element 162 is moved backwardly from the foremost axial position. The cross sectional area of the annular orifice thus formed in the opening 156 is variable depending upon the axial position of the needle valve element 162 with respect to the opening 156 as will be readily understood. The needle valve element 162 projects outwardly from the recess 160 at the outer axial end of the elongated bore 158 and has an annular flange portion 166 at its outer axial end. A helical compression spring 168 is seated at one end on the inner face of the flange portion 166 and at the other end in the recess 160 in the main body 140 so that the needle valve element 162 is urged away from the above-mentioned foremost axial position fully closing the opening 156 in the intermediate wall portion 154 of the main body 140 by the tapered inner end portion 164 of the valve element 162.

A foot-operated bell-crank lever or pedal 170 has an intermediate fulcrum portion pivotally mounted on the main body 140 by means of a pin 172 which is assumed to have a substantially horizontal center axis so that the pedal 170 is rotatable in a vertical plane. The pedal 170 has a first arm portion 174 extending in one direction from the fulcrum portion and engageable at the leading end thereof with the flange portion 166 of the needle valve element 162 and a second arm portion 176 extending first downwardly opposite to the first arm portion 174 and turned slightly upwardly toward its leading end, as shown. The second arm portion 176 is fixedly connected at its leading end to a pedal plate 178 which is located to allow easy access to an operator's foot. The main body 140 is formed with a recess 180 facing the second arm portion 176 of the pedal 170, which on the other hand is formed with a projection 182 directed toward the recess 180. A helical compression spring 184 is seated at one end in the recess 180 and is retained at the other end by the projection 182 for urging the pedal 170 to turn about the center axis of the pin 172 counterclockwise in FIG. 4, viz., in a direction to have the first arm portion 174 of the pedal 170 downwardly inclined. The first arm portion 174 of the pedal 170 is thus held in pressing contact at its leading end with the flange portion 166 of the needle valve element 162 by the force of the compression spring 168 urging the needle valve element 162 toward the leading end of the first arm portion 174 of the pedal 170 and the force of the compression spring 184 urging the first arm portion 174 of the pedal against the flange portion 166 of the needle valve element 162 at its leading end. The compression springs 168 and 184 are selected so that the force of the former is smaller than the force of the latter so that the needle valve element 162 is urged toward the previously mentioned foremost axial position thereof fully closing the tapered opening 156 in the intermediate wall portion 154 of the main body 140 against the force of the compression spring 168 directly acting on the valve element 162, the force effective to urge the needle valve element 162 toward the particular axial position being the difference between the forces of the springs 168 and 184. When the pedal 176 is kept released, the pedal 170 is held in an angular position having the needle valve element 162 maintained in the foremost axial position thereof fully closing the opening 156 between the first and second bore portions 142 and 144, as illustrated. If desired, the compression spring 184 thus acting on the second arm portion 176 of the pedal 170 may be replaced with a tension spring (not shown) connected between the first arm portion 174 of the pedal 170 and a closest portion of the main body 140.

An adjustment screw 186 or, in general, an elongated, externally threaded member is screwed to the main body 140 through an internally threaded hole 188 in the main body 140. The adjustment screw 186 projects from the main body 140 and has its leading end or head located in the path of the second arm portion 176 of the pedal 170 rotatable about the center axis of the pin 172. When the pedal 170 is kept released and is held in the angular position maintaining the needle valve element 162 in the foremost axial position thereof as above described, the adjustment screw 186 has its leading end or head spaced apart a predetermined distance from the second arm portion 176 of the pedal 170. The spacing between the leading end or head of the adjustment screw 186 and the second arm portion 176 of the pedal 170 in the released position can be varied by varying the length in which the adjustment screw 186 is inserted into the internally threaded hole 188 in the main body 140. The main body 140 is fixedly mounted on a suitable support member or structure 190 by suitable fastening means such as bolts 192 only one of which is shown in FIG. 4.

A first fluid conducting pipe 194 is fixedly fitted to the end plate 146 by means of a clamping member 196 so that the longitudinal bore in the pipe 194 is open at one end to the opening 148 in the end plate 146 and is accordingly in communication with the first bore portion 142 in the main body 140 through the opening 148. Likewise, a second fluid conducting pipe 198 is fixedly fitted to the end plate 146 by means of a clamping member 200 so that the longitudinal bore in the pipe 198 is open at one end to the opening 150 in the end plate 146 and is accordingly in communication with the second bore portion 144 in the main body 140 through the opening 150 in the end plate 146. The longitudinal bore in the first fluid conducting pipe 194 constitutes the passageway 52 leading from the fluid source 10 through the pressure regulator 14 and the longitudinal bore in the second fluid conducting pipe 198 constitutes the passageway 60 leading to the fluid storage chamber 28 in the arrangement of FIG. 1. When the integral flow restriction the manually-operated auxiliary valve unit 58c thus united is put to use in the arrangement of FIG. 1, the passageway 56 interconnecting the valve unit 50 and the flow restriction unit 58 can be dispensed with.

When, now, the weaving loom is being operated in normal condition, the pedal 170 of the arrangement shown in FIG. 4 is kept released so that the needle valve element 162 is held in the previously mentioned foremost axial position thereof fully closing the tapered opening 156 in the intermediate wall portion 154 of the main body 140 by the tapered end portion 164 thereof as previously described. Communication between the first and second bore portions 142 and 144 in the main body 140 is therefore kept blocked and accordingly the fluid which has reached the first bore portion 142 through the fluid inlet passageway 52 in the first fluid conducting pipe 194 is not allowed into the fluid outlet passageway 60 in the second fluid conducting pipe 198. Under these conditions, the integral flow-restriction and manual valve unit shown in FIG. 4 serves as a flow shut-off valve unit.

When the weaving loom is brought to a full stop and is to be thereafter restarted from the rest condition, the integral flow-restriction and manual valve unit shown in FIG. 4 is put into use so that the pick of weft yarn which has been imperfectly inserted into the weaving shed of the loom by the jet stream of the fluid shot into the shed at the final stage of the preceding weaving operation be correctly inserted into the shed before the regular cycles of weaving operation are to be started. When, thus, an operator depresses the pedal 170 with his foot on the pedal plate 178, the pedal 170 is rotated about the center axis of the pin 172 in clockwise direction in FIG. 4, viz., in the direction of arrow *d* against the force of the compression spring 184 until the second arm portion 176 of the pedal 170 is brought into abutting engagement with the adjustment screw 186 projecting from the main body 140. As the pedal 170 is thus turned, the first arm portion 174 of the pedal 170 is upwardly inclined and allows the needle valve element 162 to move upwardly as indicated by arrow *e* by the force of the compression spring 168 seated on the valve element 162 so that the tapered end portion 164 of the valve element 162 is unseated from the intermediate wall portion 154 between the first and second bore portions 142 and 144. The opening 156 in the intermediate wall portion 154 is now allowed to open and forms an annular gap or orifice around the tapered end portion 164 of the needle valve element 162, providing restricted fluid communication between the first and second bore portions 142 and 144 in the main body 140. The fluid which has reached the first bore portion 142 through the fluid inlet passageway 52 in the first fluid conducting pipe 194 as indicated by arrow *f* is allowed to flow through the annular orifice into the second bore portion 144 and is directed through the opening 150 in the end plate 146 into the fluid outlet passageway 60 in the second fluid conducting pipe 198 as indicated by arrow *f*. The flow rate of the fluid allowed from the first bore portion 142 into the second bore portion 144 and, accordingly, the degree of the decrement in the fluid pressure developed in the second bore portion 144 are, thus, dictated by the cross sectional area of the annular gap or orifice formed in the opening 156. The cross sectional area of such an orifice is, in turn, dictated by the lift or the distance of axial movement of the needle valve element 162 from the foremost axial position thereof seated on the intermediate wall portion 154. The lift of the needle valve element 162 is, furthermore, dictated by the angle through which the pedal 170 is allowed to turn about the center axis of the pin 172 and accordingly by the spacing between the leading end or head of the adjustment screw 186 and the second arm portion 176 of the pedal 170 in the angular position effective to hold the needle valve element 162 in the rearmost axial position thereof. Thus, the flow rate of the fluid passed from the fluid inlet passageway 52 to the fluid outlet passageway 60 and accordingly the degree of the decrement in the fluid pressure in the fluid outlet passageway 60 can be continuously varied by adjusting the axial position of the adjustment screw 186 relative to the second arm portion 176 of the pedal 170. When the first pick of weft yarn is completely inserted into the weaving shed of the loom, the pedal 170 is released so that the needle valve element 172 is axially moved into the foremost axial position fully closing the opening 156 in the intermediate wall portion 154 so as to block the communication between the first and second bore portions 142 and 144 as in the initial condition.

If desired, the second fluid conducting pipe 198 providing the fluid outlet passageway 60 which has been assumed to be connected to the fluid storage chamber 28 of the arrangement of FIG. 1 may be connected to the passageway 30 between the fluid storage chamber 28 and the flow control valve unit 32 or to the passageway 46 between the flow control valve unit 32 and the fluid discharge nozzle 48. As an alternative, the first and second fluid conducting pipes 194 and 198 may be utilized for providing fluid outlet and inlet passageways, respectively.

Figure 5:
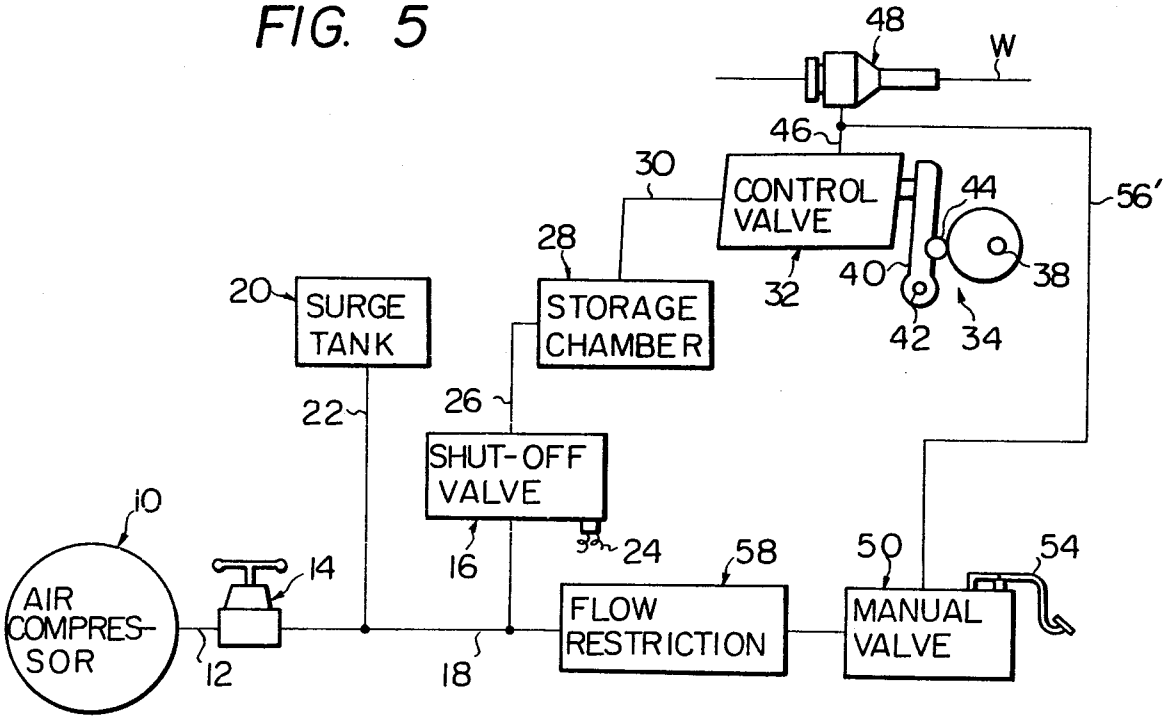
FIGS. 5 and 6 are block diagrams schematically showing modifications of the fluid supplying and discharging apparatus illustrated in FIG. 1.
Figure 6:
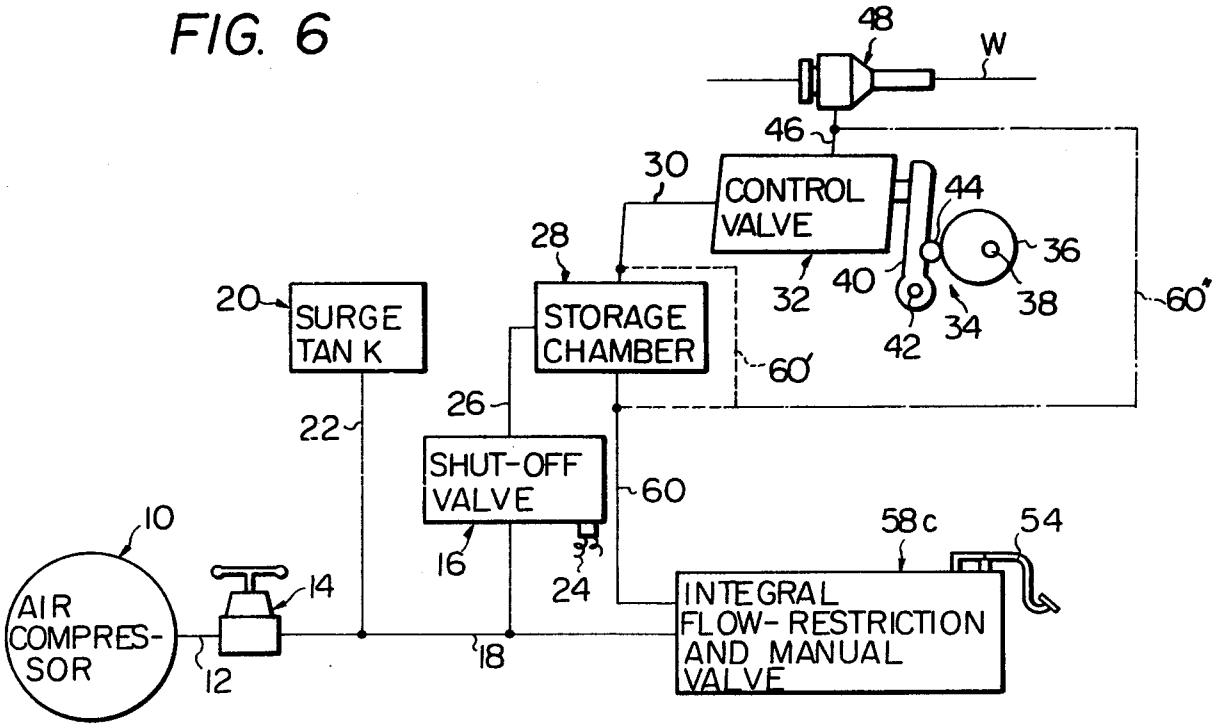

In FIG. 5, the flow restriction unit 58 is shown provided between the pressure regulator 14 and the manually-operated auxiliary valve unit 50 which has its outlet port in communication with the passageway 46 between the flow control valve unit 32 and the fluid discharge nozzle 48 as indicated by line 56'. FIG. 6 shows the arrangement in which the integral flow-restriction and manual valve unit 58c illustrated in FIG. 4 is used in lieu of the separate flow restriction and manually-operated auxiliary valve units 50 and 58 in each of the arrangements illustrated in FIGS. 1 and 5. The integral flow restriction and manual valve unit 58c is shown to have its outlet port in communication with the fluid storage chamber 28 through the passageway 60 but, if desired, the fluid outlet port of the unit 58c may be in communication with the passageway 30 between the fluid storage chamber 28 and the intermittent-motion flow control valve unit 32 as indicated by dotted line 60' or with the passageway 46 between the flow control valve unit 32 and the fluid discharge nozzle 48 as indicated by dot-and-dash line 60''.

What is claimed is:

1. A fluid supplying and discharging apparatus for use in a weaving loom of the shuttleless type, comprising a source of fluid under pressure, fluid discharge means communicable with the fluid source and operative to eject a jet stream of the fluid into a weaving shed formed by warp yarns in the loom, first valve means provided between said fluid source and said fluid discharge means and operative to intermittently open in synchronism with the weaving cycles of the loom, second valve means provided between said first valve means and said fluid source and operative to establish communication between the fluid source and the first valve means in response to operative condition of the loom, the second valve means interrupting the communication between the fluid source and the first valve means in response to inoperative condition of the loom, third valve means bypassing said second valve means from said fluid source, the third valve means being manually operable for providing communication between the fluid source and the fluid discharge means when manually operated to open, and flow restriction means for reducing to a predetermined level the pressure of the fluid to be passed to said fluid discharge means through said third valve means.

2. A fluid supplying and discharging apparatus as set forth in claim 1, in which said flow restriction means is provided between said fluid source and said third valve means.

3. A fluid supplying and discharging apparatus as set forth in claim 2, in which said third valve means has a fluid outlet port located to intervene between said first and second valve means.

4. A fluid supplying and discharging apparatus as set forth in claim 2, in which said third valve means has a fluid outlet port located to intervene between said first valve means and said fluid discharge means.

5. A fluid supplying and discharging apparatus as set forth in claim 1, in which said flow restriction means is provided between said third valve means and said fluid discharge means.

6. A fluid supplying and discharging apparatus as set forth in claim 5, in which said flow restriction means has a fluid inlet port located downstream of said third valve means and a fluid outlet port located to intervene between the first and second valve means.

7. A fluid supplying and discharging apparatus as set forth in claim 5, in which said flow restriction means has a fluid inlet port located downstream of said third valve means and a fluid outlet port located to intervene between said first valve means and said fluid discharge means.

8. A fluid supplying and discharging apparatus as set forth in claim 1, further comprising fluid storage means provided between the first and second valve means and operative to temporarily store therein a predetermined volume of fluid to be consumed for each weft shooting operation at said fluid discharge means and delivering the predetermined volume of fluid to the fluid discharge means through said first valve means when the first valve means and at least one of the second and third valve means are concurrently open.

9. A fluid supplying and discharging apparatus as set forth in claim 8, in which said flow restriction means is provided between said fluid source and said third valve means.

10. A fluid supplying and discharging apparatus as set forth in claim 9, in which said third valve means has a fluid outlet port communicating with said fluid storage means.

11. A fluid supplying and discharging apparatus as set forth in claim 9, in which said third valve means has a fluid outlet port intervening between said fluid storage means and said first valve means.

12. A fluid supplying and discharging apparatus as set forth in claim 9, in which said third valve means has a fluid outlet port intervening between said first valve means and said fluid discharge means.

13. A fluid supplying and discharging apparatus as set forth in claim 8, in which said flow restriction means has a fluid inlet port located downstream of said third valve means and a fluid outlet port communicating with said fluid storage means.

14. A fluid supplying and discharging apparatus as set forth in claim 8, in which said flow restriction means has a fluid inlet port located downstream of said third valve means and a fluid outlet port intervening between said fluid storage means and said first valve means.

15. A fluid supplying and discharging apparatus as set forth in claim 8, in which said flow restriction means has a fluid inlet port located downstream of said third valve means and a fluid outlet port intervening between said first valve means and said fluid discharge means.

16. A fluid supplying and discharging apparatus as set forth in claim 15, in which said first and second bore portions have respective center axes which are substantially in line with each other.

17. A fluid supplying and discharging apparatus as set forth in claim 16, further comprising an annular member removably disposed within one of said first and second bore portions, said orifice being constituted by the opening in said annular member.

18. A fluid supplying and discharging apparatus as set forth in claim 17, in which said first and second bore portions have different diameters and have respective inner axial ends at which the bore portions are conjoined to each other and form an annular wall face at the inner axial end of the bore portion having a larger diameter, said annular member being disengageably fitted to said annular wall face.

19. A fluid supplying and discharging apparatus as set forth in claim 1, in which said flow restriction means comprises a main body formed with first and second bore portions, first and second tubular members each formed with a longitudinal bore open at both ends of the tubular member, the first and second tubular members being disengageably mounted on said main body for providing communication between said first bore portion and the longitudinal bore in said first tubular member and between said second bore portion and the longitudinal bore in said second tubular member, and an orifice formed between said first and second bore portions.

20. A fluid supplying and discharging apparatus as set forth in claim 19, in which said flow restriction means is constructed separately of said third valve means.

21. A fluid supplying and discharging apparatus as set forth in claim 20, in which said first and second bore portions are at least in part substantially parallel with each other, said main body having a wall portion between said first and second bore portions and being formed with an opening in said wall portion for providing communication between the first and second bore portions.

22. A fluid supplying and discharging apparatus as set forth in claim 21, in which said flow restriction means further comprising a tapered member projecting into said opening in said wall portion for forming in the opening an annular gap by which said orifice is constituted.

23. A fluid supplying and discharging apparatus as set forth in claim 22, in which said flow restriction means further comprises manually-operated adjusting means for axially moving said tapered member through said opening for varying the cross sectional area of said orifice.

24. A fluid supplying and discharging apparatus as set forth in claim 22, in which said opening is tapered from one of the first and second bore portions to the other substantially conformingly to said tapered member.

25. A fluid supplying and discharge apparatus as set forth in claim 24, in which said tapered member axially extends substantially perpendicularly through said one of the first and second bore portions.

26. A fluid supplying and discharging apparatus as set forth in claim 20, in which the longitudinal bore in one of said first and second tubular members constitutes a fluid inlet passageway and is in communication with said fluid source and the longitudinal bore in the other tubular member constitutes a fluid outlet passageway and is in communication with said third valve means.

27. A fluid supplying and discharging apparatus as set forth in claim 20, in which the longitudinal bore in one of said first and second tubular members constitutes a fluid inlet passageway and is in communication with said third valve means and the longitudinal bore in the other tubular member constitutes a fluid outlet passageway and terminates between said first and second valve means.

28. A fluid supplying and discharging apparatus as set forth in claim 20, in which the longitudinal bore in one of said first and second tubular members constitutes a fluid inlet passageway and is in communication with said third valve means and the longitudinal bore in the other tubular member constitutes a fluid outlet passageway and terminates between said first valve means and said fluid discharge means.

29. A fluid supplying and discharging apparatus as set forth in claim 19, in which said flow restriction means and said third valve means are constructed in a single unit comprising said main body, said first and second tubular members and said orifice.

30. A fluid supplying and discharging apparatus as set forth in claim 29, in which said main body has a wall portion between said first and second bore portions and is formed with an opening for providing communication between the bore portions, said single unit further comprising a valve element which has a tapered axial end portion projecting into said opening and which is axially movable into and out of a foremost axial position having said opening closed by said tapered axial end portion thereof, first biasing means for urging said valve element away from said foremost axial position, a manually-operated lever means engaging said valve element and rotatable anout a fixed axis in a plane to which the direction of axial movement of said valve element is normal, and second biasing means for urging said lever means to turn about said axis in a direction to move said valve element toward said foremost axial position thereof, the force of said second biasing means being greater than the force of said first biasing means.

31. A fluid supplying and discharging apparatus as set forth in claim 30, in which said single unit further comprises stop means for limiting the rotation of said lever means in a direction opposite to the direction to move said valve element toward said foremost axial position thereof, said stop means being mounted on said main body and having an adjustable position relative to said lever means.

32. A fluid supplying and discharging apparatus as set forth in claim 31, in which said main body is further formed with an elongated bore which is open at one end to one of said first and second bore portions and at an external face of the main body and which is substantially in line with said opening in said wall portion of the main body, said valve element being axially slidable through said elongated bore and having said tapered axial end portion movable through said one of the first and second bore portions and the other axial end portion projecting from said external face of the main body and engaged by said lever means.

33. A fluid supplying and discharging apparatus as set forth in claim 32, in which said first and second bore portions are substantially parallel with each other on both sides of said wall portion.

34. A fluid supplying and discharging apparatus as set forth in claim 33, in which said elongated bore and said opening have respective center axes which are substantially in line with each other perpendicularly to said first and second bore portions.

35. A fluid supplying and discharging apparatus as set forth in claim 30, in which said opening in said wall portion is tapered from one of said first and second bore portions toward the other substantially conformingly to said tapered axial end portion of said valve element.

36. A fluid supplying and discharging apparatus as set forth in claim 29, in which the longitudinal bore in one of said first and second tubular members constitutes a fluid inlet passageway and is in communication with said fluid source and the longitudinal bore in the other tubular member constitutes a fluid outlet passageway and terminates between said first and second valve means.

37. A fluid supplying and discharging apparatus as set forth in claim 29, in which the longitudinal bore in one of said first and second tubular members constitutes a fluid inlet passageway and is in communication with said fluid source and the longitudinal bore in the other tubular member constitutes a fluid outlet passageway and terminates between said first valve means and said fluid discharge means.

38. A fluid supplying and discharging apparatus as set forth in claim 1, in which said third valve means comprises solenoid-operated valve actuating means including manually-operated switch means.

* * * * *